US011277704B2

(12) United States Patent
Yuyama

(10) Patent No.: US 11,277,704 B2
(45) Date of Patent: Mar. 15, 2022

(54) ACOUSTIC PROCESSING DEVICE AND ACOUSTIC PROCESSING METHOD

(71) Applicant: YAMAHA CORPORATION, Hamamatsu (JP)

(72) Inventor: Yuta Yuyama, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/927,141

(22) Filed: Jul. 13, 2020

(65) Prior Publication Data

US 2021/0021950 A1 Jan. 21, 2021

(30) Foreign Application Priority Data

Jul. 16, 2019 (JP) ..... JP2019-130884

(51) Int. Cl.
*H04S 7/00* (2006.01)
*H04S 5/00* (2006.01)
*H04S 3/00* (2006.01)

(52) U.S. Cl.
CPC ..... *H04S 7/302* (2013.01); *H04S 3/008* (2013.01); *H04S 5/005* (2013.01); *H04S 2400/01* (2013.01); *H04S 2400/11* (2013.01); *H04S 2400/13* (2013.01)

(58) Field of Classification Search
CPC ..... H04S 7/302; H04S 3/008; H04S 2400/01; H04S 2400/11; H04S 2400/13; H04S 2400/03; H04S 7/30; H04S 5/005
See application file for complete search history.

(56) References Cited

U.S. PATENT DOCUMENTS

| | | | |
|---|---|---|---|
| 10,789,972 | B2 | 9/2020 | Yuyama |
| 2007/0154020 | A1 | 7/2007 | Katayama |
| 2011/0176684 | A1 | 7/2011 | Katayama |
| 2012/0328109 | A1 | 12/2012 | Harma |

FOREIGN PATENT DOCUMENTS

| | | | |
|---|---|---|---|
| EP | 3048818 | A1 | 7/2016 |
| EP | 3573352 | A1 | 11/2019 |
| JP | 2007202139 | A | 8/2007 |
| WO | 2018155481 | A1 | 8/2018 |

OTHER PUBLICATIONS

Extended European Search Report issued in European Application No. 20185667.1 dated Dec. 3, 2020.
Office Action issued in Chinese Appln. No. 202010643982.1 dated Jun. 23, 2021. English machine translation provided.

*Primary Examiner* — Ping Lee
(74) *Attorney, Agent, or Firm* — Rossi, Kimms & McDowell LLP

(57) ABSTRACT

An acoustic processing device including a memory storing instructions and a processor that implements the stored instructions to execute a plurality of tasks, the tasks including: an analyzing task that analyzes an input signal; a determining task that determines an acoustic effect to be applied to the input signal, from among a first acoustic effect of virtual surround and a second acoustic effect of virtual surround different from the first acoustic effect, based on a result of the analyzing task; and an acoustic effect applying task that applies the acoustic effect determined by the determining task to the input signal.

20 Claims, 5 Drawing Sheets

ACOUSTIC PROCESSING DEVICE AND ACOUSTIC PROCESSING METHOD

CROSS REFERENCE TO RELATED APPLICATIONS

This application is based on Japanese Patent Application (No. 2019-130884) filed on Jul. 16, 2019, the contents of which are incorporated herein by reference.

BACKGROUND OF THE INVENTION

1. Field of the Invention

The present disclosure relates to an acoustic processing device and an acoustic processing method.

2. Description of the Related Art

In the related art, there is a technique in which an acoustic signal of a rear channel is output from a front speaker to localize a sound image as if a sound is output from a virtual rear speaker (for example, see JP-A-2007-202139). This kind of sound image localization technology is also called virtual surround, and if, for example, listeners are watching a movie, the virtual surround can provide listeners with an appropriate surround feeling by localizing a virtual sound image in the rear even if the number of speakers is small.

However, the above technique has a problem that, for example, in a scene of a movie, specifically, in a front sound field or a scene in which a person speaks lines, the sound field spreads to give the listeners an unnatural feeling.

SUMMARY OF THE INVENTION

Illustrative aspects of the present disclosure provide an acoustic processing device including a memory storing instructions and a processor that implements the stored instructions to execute a plurality of tasks, the tasks including: an analyzing task that analyzes an input signal; a determining task that determines an acoustic effect to be applied to the input signal, from among a first acoustic effect of virtual surround and a second acoustic effect of virtual surround different from the first acoustic effect, based on a result of the analyzing task; and an acoustic effect applying task that applies the acoustic effect determined by the determining task to the input signal.

Other aspects and advantages of the disclosure will be apparent from the following description, the drawings and the claims.

DETAILED DESCRIPTION OF THE EXEMPLARY EMBODIMENTS

An acoustic processing device according to an embodiment of the present disclosure will be described with reference to the drawings.

Figure 1:
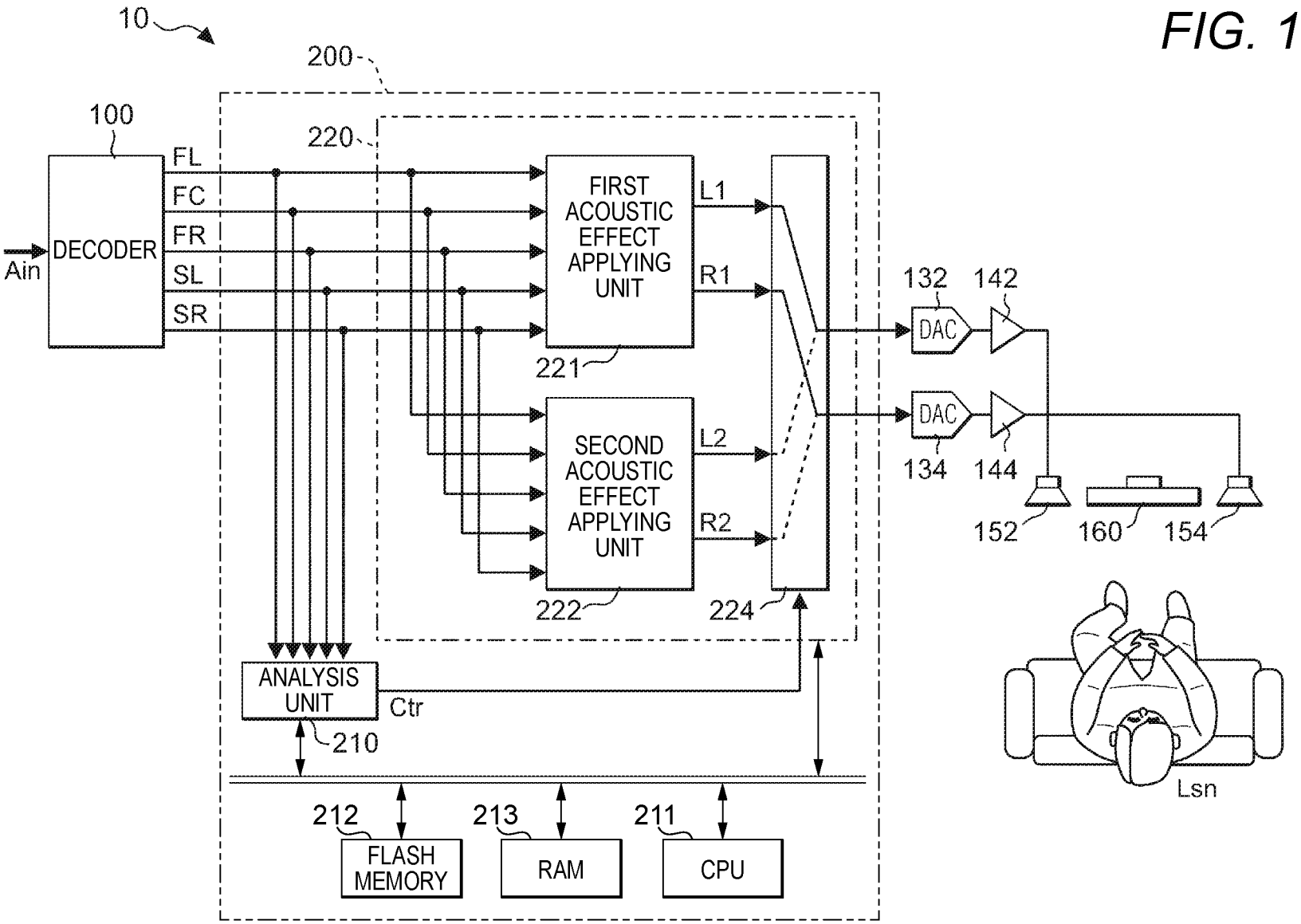
FIG. 1 is a diagram showing a sound applying system including an acoustic processing device according to a first embodiment.

FIG. 1 is a diagram showing a configuration of a sound applying system including the acoustic processing device.

A sound applying system 10 shown in FIG. 1 applies a virtual surround effect by two speakers 152, 154 disposed in front of a listener Lsn.

The sound applying system 10 includes a decoder 100, an acoustic processing device 200, DACs 132, 134, amplifiers 142, 144, speakers 152, 154, and a monitor 160.

The decoder 100 inputs an acoustic signal Ain among signals output from a reproducer reproducing a recording medium (not shown). The recording medium mentioned here is, for example, a Digital Versatile Disc (DVD) or a Blu-ray Disc (BD: registered trademark), and for example, a video signal and an acoustic signal, such as a movie or a music video, are recorded in synchronization with each other.

Among the signals output from the reproducer, the video based on the video signal is displayed on the monitor 160.

The decoder 100 inputs and decodes the acoustic signal Ain, and outputs, for example, the following five-channel acoustic signals. Specifically, the decoder 100 outputs the acoustic signals of a front left channel FL, a front center channel FC, a front right channel FR, a rear left channel SL, and a rear right channel SR. However, the number of channels of the acoustic signals output from the decoder 100 are not limited to the five channels, those are, the front left channel FL, the front center channel FC, the front right channel FR, the rear left channel SL, and the rear right channel SR. For example, the acoustic signals of two channels, those are a right channel and a left channel, may be output from the decoder 100, and also the acoustic signals of 7 channels may be output from the decoder 100.

The acoustic processing device 200 includes an analysis unit 210, an acoustic effect applying unit 220, a CPU 211, a flash memory 212, and a RAM 213. The CPU 211 reads an operation program (firmware) stored in the flash memory 212 to the RAM 213, and integrally controls the acoustic processing device 200. The analysis unit 210 inputs and analyzes the acoustic signal of each channel output from the decoder 100, and outputs a signal Ctr indicating a selection of one of a first acoustic effect and a second acoustic effect as an effect applied to the acoustic signal according to an instruction of the CPU 211.

The acoustic effect applying unit 220 includes a first acoustic effect applying unit 221, a second acoustic effect applying unit 222, and a selection unit 224.

According to an instruction of the CPU 211, the first acoustic effect applying unit 221 performs signal processing on the five-channel acoustic signals, thereby outputting the acoustic signals of the left channel L1 and the right channel R1 to which the first acoustic effect is applied. Also, according to an instruction of the CPU 211, the second acoustic effect applying unit 222 performs signal processing on the five-channel acoustic signals, thereby outputting the acoustic signals of the left channel L2 and the right channel R2 to which the second acoustic effect different from the first acoustic effect is applied.

The selection unit 224 selects a set of the channels L1, R1 or a set of the channels L2, R2 according to the signal Ctr, and supplies the acoustic signal of the left channel of the selected set of channels to the DAC 132 and the acoustic signal of the right channel to the DAC 134.

Solid lines in FIG. 1 show a state in which the selection unit 224 selects the channels L1, R1 by the signal Ctr, and broken lines show a state in which the selection unit 224 selects the channels L2, R2.

The digital to analog converter (DAC) 132 converts the acoustic signal of the left channel selected by the selection unit 224 into an analog signal, and the amplifier 142 amplifies the signal converted by the DAC 132. The speaker 152 converts the signal amplified by the amplifier 142 into vibration of air, that is, a sound, and outputs the sound.

Similarly, the DAC 134 converts the acoustic signal of the right channel selected by the selection unit 224 into an analog signal, the amplifier 144 amplifies the signal converted by the DAC 134, and the speaker 154 converts the signal amplified by the amplifier 142 into a sound and outputs the sound.

The first acoustic effect applied by the first acoustic effect applying unit 221 is, for example, an effect applied by a feedback cross delay.

In the feedback cross delay, a left delay is fed back to a right input, and a right delay is fed back to a left input and then added. Therefore, in the first acoustic effect, an effect that the sound can be heard stereoscopically is generally obtained.

The second acoustic effect applied by the second acoustic effect applying unit 222 is, for example, an effect applied by trans-aural processing.

Trans-aural is a technique for reproducing, for example, a binaurally recorded sound with a stereo speaker instead of with headphones. However, when the sound is simply reproduced with the speaker instead of with the headphones, crosstalk occurs, and thus the trans-aural also includes processing for canceling the crosstalk.

Figure 2:
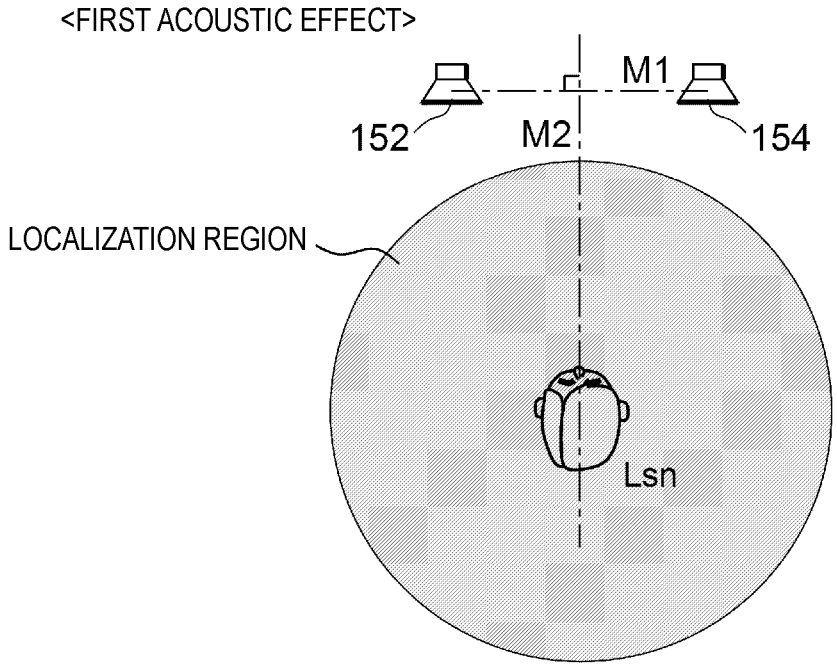
FIG. 2 is a diagram showing a localization region due to a first acoustic effect.
Figure 3:
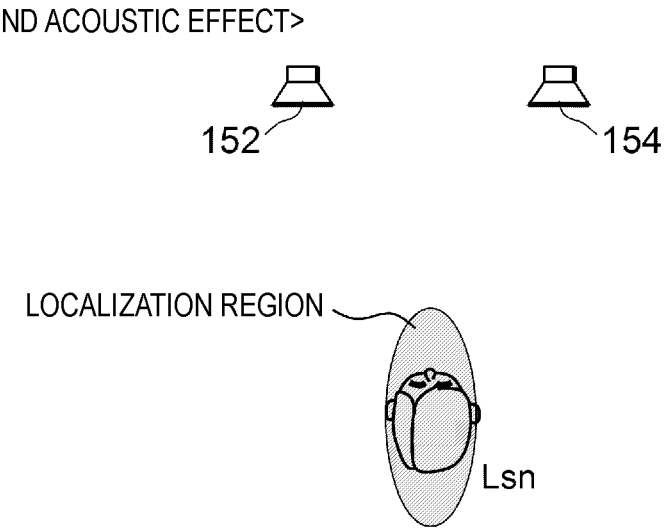
FIG. 3 is a diagram showing a localization region due to a second acoustic effect.

FIG. 2 is a diagram showing a range of a localization region where localization of a sound image is obtained in the first acoustic effect in a case that the listener, disposed at a position within the range of the localization region, listens an emitted sound based on the input signal to which the first acoustic effect is applied, and FIG. 3 is a diagram showing a range of a localization region due to the second acoustic effect. All of the positions of the speakers 152, 154 and the listener Lsn are shown in a plan view. As can be seen from a comparison between these figures, the localization region is in a front side of a direction in which the speakers 152, 154 emit sound, and the localization region of the first acoustic effect is wider than that of the second acoustic effect. In other words, the localization region is pinpointed at the second acoustic effect.

This localization region is an example in which the head of the listener Lsn is located at a vertical bisector M2 of a virtual line M1 connecting the speakers 152, 154, and the face of the listener Lsn faces the speakers 152, 154 in a direction along the vertical bisector M2.

Figure 4:
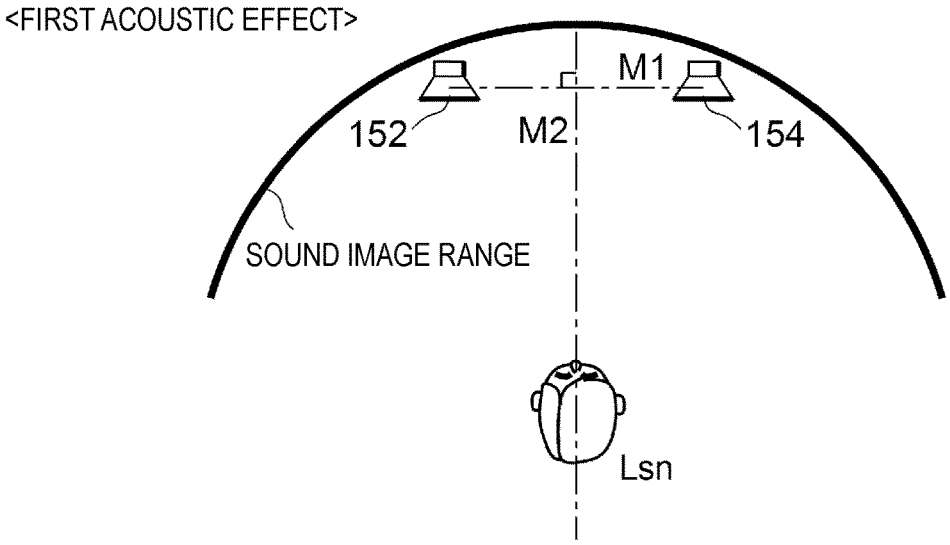
FIG. 4 is a diagram showing the spread of a sound image due to the first acoustic effect.
Figure 5:
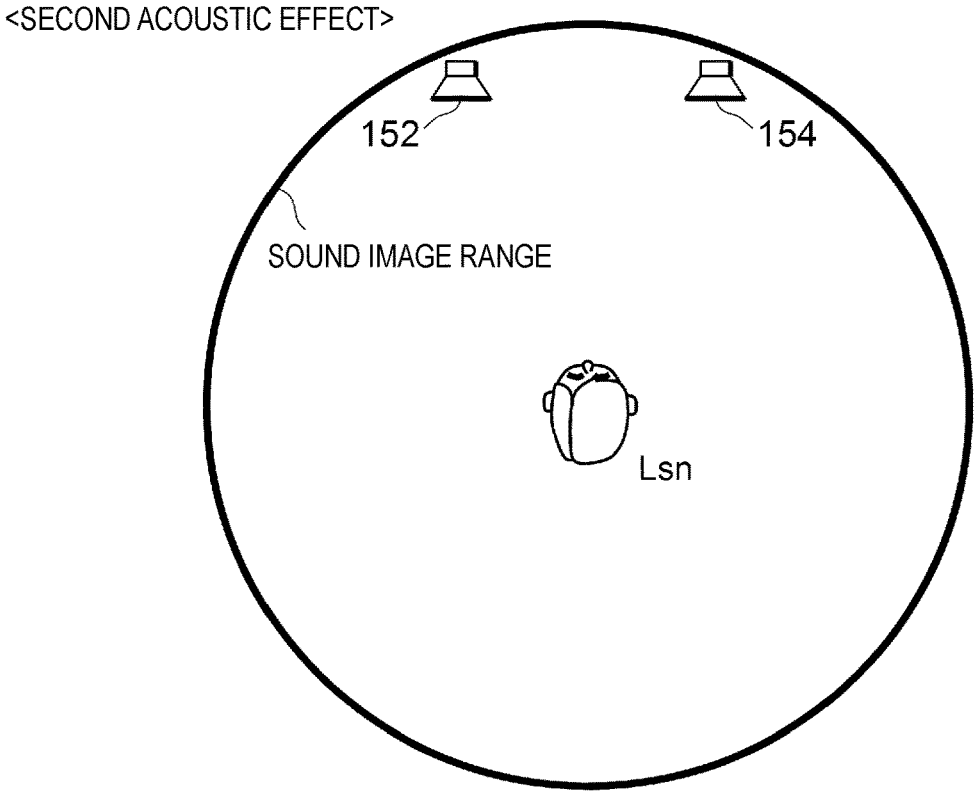
FIG. 5 is a diagram showing the spread of a sound image due to the second acoustic effect.

FIG. 4 is a diagram showing a range (sound image range) where a sound image can be localized when viewed from the listener Lsn due to the first acoustic effect, and FIG. 5 is a diagram showing a sound image range due to the second acoustic effect. All of the positions of the speakers 152, 154 and the listener Lsn are shown in the plan view. As shown in FIG. 4, the sound image range due to the first acoustic effect spreads toward the front of the speakers 152, 154 when viewed from the listener Lsn. On the other hand, as shown in FIG. 5, the sound image range due to the second acoustic effect spreads over almost 360 degrees as viewed from the listener Lsn.

Here, an application of the first acoustic effect is effective in a scene where a front sound field is important and the like. Examples of this scene include the level of the front channels FL, FR being relatively large compared to the level of the rear channels SL, SR.

On the other hand, an application of the second acoustic effect is effective in a scene where localization of a sound source is important or a scene where a sound field other than the front sound field is important. Examples of this scene include a state in which an effect sound and the like is distributed to the channels FL, SL or the channels FR, SR, a state in which a sound, an effect sound and the like are distributed to the channels SL, SR, and the like.

In the sound applying system 10 according to the present embodiment, the acoustic processing device 200 analyzes the acoustic signal of each channel output from the decoder 100 by the following operation, selects one of the first acoustic effect and the second acoustic effect according to the analysis result, and applies an acoustic effect.

Figure 6:
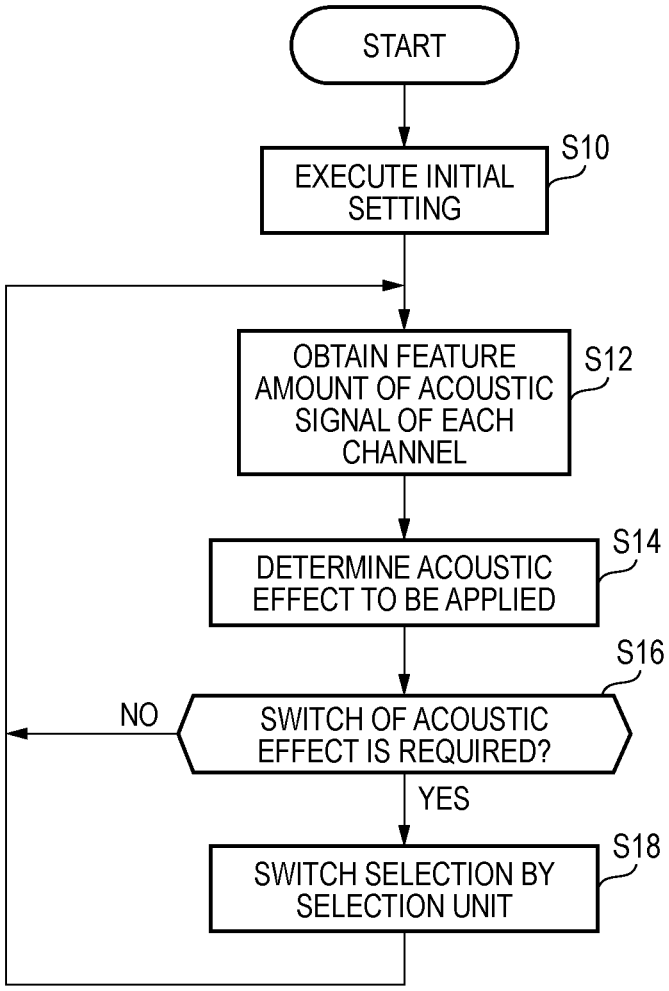
FIG. 6 is a flowchart showing an operation of the acoustic processing device.

FIG. 6 is a flowchart showing an operation of the acoustic processing device 200.

First, the analysis unit 210 starts this operation when a power supply is turned on or when the acoustic signal of each channel decoded by the decoder 100 is input.

First, the analysis unit 210 executes initial setting processing (step S10). Examples of the initial setting processing include, for example, processing of selecting the set of channels L1, R1 as an initial selection state in the selection unit 224.

Next, the analysis unit 210 obtains a feature amount of the acoustic signal of each channel decoded by the decoder 100 (step S12). In the present embodiment, a volume level is used as an example of the feature amount.

Subsequently, the analysis unit 210 determines which one of the first acoustic effect and the second acoustic effect should be newly selected based on the obtained feature amount (step S14). Specifically, in the present embodiment, the analysis unit 210 obtains a ratio of a sum of a volume level of the channel FL and a volume level of the channel FR to a sum of a volume level of the channel SL and a volume level of the channel SR. That is, the analysis unit 210 obtains the ratio of the volume level of the front channels to the volume level of the rear channels. If the obtained ratio is equal to or greater than a predetermined threshold, the analysis unit 210 determines to newly select the first acoustic effect, and if the ratio is less than the threshold, the analysis unit 210 determines to select the second acoustic effect.

Here, when the ratio is equal to or greater than the threshold, the analysis unit 210 determines to select the first acoustic effect since it is considered that the front sound field is important. On the other hand, when the ratio is less than the threshold, the analysis unit 210 determines to select the second acoustic effect since it is considered that the sound source localization is important or the sound field other than the front sound field is important.

Although the first acoustic effect or the second acoustic effect is selected depending on whether the ratio is equal to or greater than the threshold, a configuration may be adopted in which, for example, a learning model is constructed using the obtained feature amount, classification is performed by machine learning, and the first acoustic effect or the second acoustic effect is selected according to the result.

The analysis unit 210 determines whether there is a difference between the acoustic effect determined to be newly selected and the selected acoustic effect at the present moment, that is, whether the acoustic effect selected by the selection unit 224 needs to be switched (step S16).

For example, when it is determined that the first acoustic effect should be newly selected, the analysis unit 210 determines that the acoustic effect needs to be switched if the selection unit 224 actually selects the second acoustic effect at the present moment. Further, for example, when it is determined that the second acoustic effect should be newly selected, the analysis unit 210 determines that there is no need to switch the acoustic effect if the selection unit 224 has already selected the second acoustic effect at the present moment.

If it is determined that it is necessary to switch the acoustic effect (if the determination result of step S16 is "Yes"), the analysis unit 210 instructs the selection unit 224 to switch the selection by the signal Ctr (Step S18). In response to this instruction, the selection unit 224 actually switches the selection from one of the first acoustic effect applying unit 221 and the second acoustic effect applying unit 222 to the other.

Thereafter, the analysis unit 210 returns the procedure of the processing to step S12.

On the other hand, if it is determined that there is no need to switch the acoustic effect (if the determination result of step S16 is "No"), the analysis unit 210 returns the procedure of the processing to step S12.

When the procedure of the processing returns to step S12, the volume level of each channel is determined again, and the acoustic effect to be newly selected is determined based on the volume level. Therefore, in the present embodiment, the analysis of each channel and the determination and selection of the acoustic effect are executed every predetermined time. This operation is repeatedly executed until the power supply is cut off or the input of the acoustic signal is stopped.

As described above, in the present embodiment, an appropriate acoustic effect is determined and selected every predetermined time in accordance with the sound field to be reproduced by the acoustic signal or the localization, and thus it is possible to prevent the listener from feeling unnatural.

In the embodiment described above, the volume level of the channel FC may be used for the analysis. Specifically, if the volume level of the channel FC is relatively large compared to the volume level of each of the other channels, it is considered that the front sound field is important, such as a scene in which a person speaks lines in front. Therefore, if the ratio of the volume level of the channel FC to the volume level of each of the other channels FL, FR, SR, and SL is equal to or greater than the threshold, the analysis unit 210 may determine to select the first acoustic effect, and otherwise determine to select the second acoustic effect.

Further, a state in which the volume level of the channel FC is increased may occur because of a component of a sound other than a voice such as lines. Therefore, the analysis unit 210 may perform frequency analysis on the acoustic signal of the channel FC to make a determination based on a ratio of the volume level limited to a voice band of, for example, 300 to 3400 Hz to the volume level of each of the other channels.

For the voice, instead of the simple frequency analysis, Mel-Frequency Cepstrum Coefficients (MFCC), which are a feature amount of the voice, may be used.

In the embodiment described above, the analysis unit 210 uses the volume level as an example of the feature amount of the acoustic signal of the channel, but the acoustic effect may be determined and selected using a volume level other than the volume level. Therefore, another example of the feature amount of the acoustic signal of the channel will be described.

Figure 7:
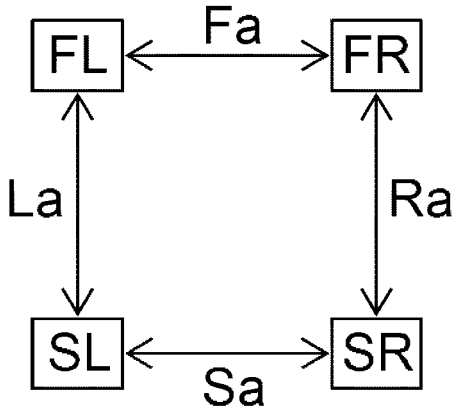
FIG. 7 is a diagram showing Example 1 regarding selection of an acoustic effect by an analysis unit.

FIG. 7 is a diagram showing Example 1 in which a degree of correlation (or similarity) is used for a feature amount of the acoustic signal of the channel. In Example 1, the analysis unit 210 calculates the degree of correlation between the acoustic signals of adjacent channels among the acoustic signals of the channels FL, FR, SL, and SR, and determines and selects an acoustic effect to be applied based on the degree of correlation.

In the figure, a degree of correlation between the channels FL, FR is Fa, a degree of correlation between the channels FR, SR is Ra, a degree of correlation between the channels SR, SL is Sa, and a degree of correlation between the channels SL, FL is La.

By using such a degree of correlation, it is possible to determine whether the sound image reproduced by the acoustic signal of each channel is directed in a specific direction or spreads evenly around the periphery.

For example, if the degree of correlation Fa is relatively larger than the other degrees of correlation Ra, Sa, and La, it is considered that the front sound field is important. Therefore, for example, if the ratio of the degree of correlation Fa to the degree of correlation Ra, Sa, or La is equal to or greater than a threshold, the analysis unit 210 may determine to select the first acoustic effect, and otherwise determine to select the second acoustic effect.

If the degree of correlation Ra, Sa, or La is relatively larger than the other degree of correlation, it is considered that the sound field other than the front sound image is important. Therefore, for example, if a ratio of the degree of correlation Ra, Sa or La to the other degree of correlation is equal to or greater than the threshold, the analysis unit 210 may determine to select the second acoustic effect, and otherwise determine to select the first acoustic effect.

The channel FC may be added to the degree of correlation in other Example 1.

Similar to the present embodiment, also in other Example 1, an appropriate acoustic effect is selected in accordance with the sound field to be reproduced by the acoustic signal or the localization, and thus it is possible to prevent the listener from feeling unnatural.

Next, Example 2 in which a radar chart (a shape of a pattern) is used as a feature amount of the acoustic signal of the channel will be described. The radar chart mentioned here is a chart in which a volume level in each channel and a localization direction are graphed.

Figure 8A:
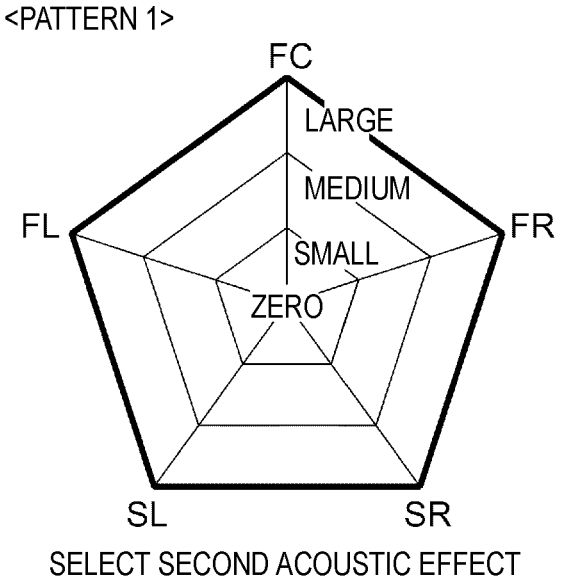
FIGS. 8A to 8D are diagrams showing Example 2 regarding selection of an acoustic effect by the analysis unit.

FIGS. 8A to 8D are diagrams showing an example of the radar chart. In this example, the volume level is classified into four of "large", "medium", "small", and "zero". Pattern 1 in FIG. 8A shows a case where the volume levels of the channels FL, FC, FR, SL, and SR are both "large". In this case, it is considered that the localization direction of the sound image spreads almost evenly around the periphery. Therefore, the analysis unit 210 determines to select the second acoustic effect.

Figure 8B:
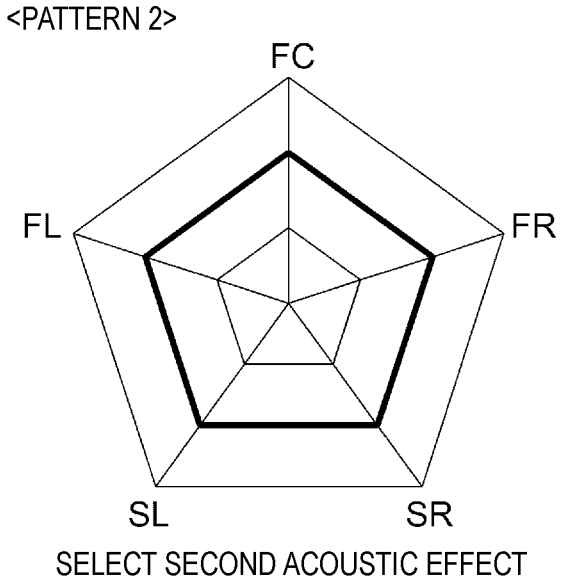

Pattern 2 in FIG. 8B shows a case where the volume levels of the channels FL, FC, FR, SL, and SR are both "medium". In this case, similar to the Pattern 1, since it is considered that the localization direction of the sound image spreads around the periphery, the analysis unit 210 determines to select the second acoustic effect.

Although not particularly shown, similar to Patterns 1 and 2, if the volume levels of the channels FL, FC, FR, SL, and SR are both "small," the analysis unit 210 determines to select the second acoustic effect.

Figure 8C:
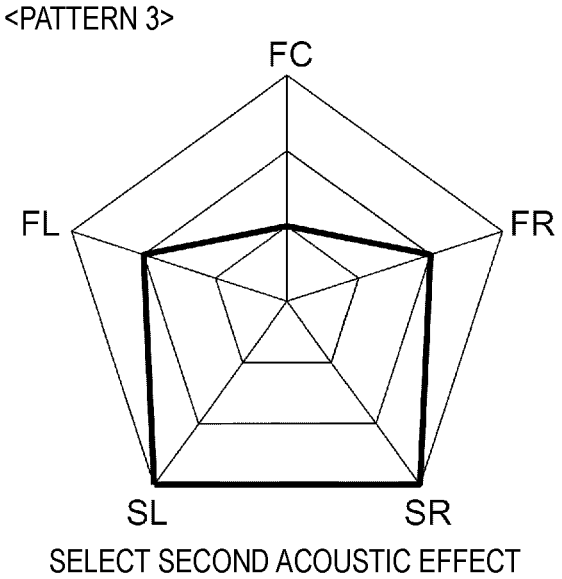
Figure 8D:
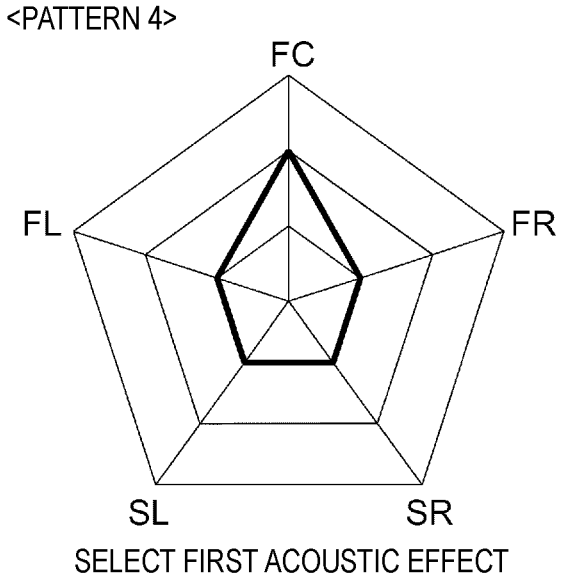

Pattern 4 in FIG. 8D shows a case where the volume levels of the channels FL, FR, SL, and SR are both "small" and the volume level of the channel FC is "medium". In this case, since it is considered that the front sound field is important, the analysis unit 210 determines to select the first acoustic effect.

Although not particularly shown, the same applies to a case where the volume levels of the channels FL, FR, SL, and SR are "small" and the volume level of the channel FC is "large", and a case where the volume levels of the channels FL, FR, SL, and SR are "medium" and the volume level of the channel FC is "large".

Pattern 3 in FIG. 8C shows a case where the volume levels of the channels FL, FR are "medium" and the volume level of the channel FC is "small". In this case, since it is considered that a rear sound field is important, the analysis unit 210 determines to select the second acoustic effect.

Here, although only typical patterns are described, there is no substitute of the present embodiment in the point that the first acoustic effect is selected in a scene where the front sound field is important, and the second acoustic effect is selected in a scene where the localization of the sound source is important or a scene where the sound field other than the front sound field is important.

In the above description, the analysis unit 210 is configured to select one of the first acoustic effect and the second acoustic effect based on the feature amount of the acoustic signal of the channel, but this selection may not necessarily match the feeling of the listener Lsn. Therefore, if the selection does not match the feeling of the listener Lsn, the analysis unit 210 may be notified, and the analysis unit 210 may record a plurality of feature amounts of the acoustic signals of the channels when the selection does not match the feeling of the listener Lsn, and learn (change) the criterion for selection.

Further, a configuration may be adopted in which a selection signal (metadata) indicating an acoustic effect to be selected is recorded on the recording medium together with the video signal and the acoustic signal, and the acoustic effect is selected according to the selection signal during reproduction. That is, the acoustic effect may be selected according to the selection signal in the input signal, and the selected acoustic effect may be applied to the acoustic signal in the input signal.

A part or all of the acoustic processing device 200 may be realized by software processing in which a microcomputer executes a predetermined program. The first acoustic effect applying unit 221, the second acoustic effect applying unit 222, and the selection unit 224 may be realized by signal processing performed by, for example, a digital signal processor (DSP).

APPENDIX

From the above-described embodiment and the like, for example, the following aspects are understood.

[1] An acoustic processing device according to an exemplary first aspect of the present disclosure includes an analysis unit configured to analyze an input signal and determine to apply a first acoustic effect of virtual surround or a second acoustic effect of virtual surround different from the first acoustic effect based on a result of an analyzation of the input signal, and an acoustic effect applying unit configured to apply the first acoustic effect or the second acoustic effect to the input signal according to a determination made by the analysis unit.

According to the first aspect, it is possible to prevent a listener from feeling unnatural in a front sound field or in a scene in which a person speaks lines.

[2] In the acoustic processing device according to the first aspect, a localization region due to the first acoustic effect is greater than a localization region due to the second acoustic effect, and a sound image range due to the first acoustic effect is smaller than a sound image range due to the second acoustic effect.

According to the second aspect, it is possible to appropriately apply the first acoustic effect or the second acoustic effect having different effects.

[3] In the acoustic processing device according to the second aspect, the input signal is acoustic signals of a plurality of channels, and the analysis unit is configured to cause the acoustic effect applying unit to select the first acoustic effect or the second acoustic effect based on feature amounts of the acoustic signals of the channels.

According to the third aspect, since the first acoustic effect or the second acoustic effect is selected based on the feature amounts of the acoustic signals of the channels, the acoustic effect can be appropriately applied.

[4] In the acoustic processing device according to the third aspect, the feature amounts of the acoustic signals of the channels are volume levels of the acoustic signals of the channels.

According to the fourth aspect, since the first acoustic effect or the second acoustic effect is selected based on the volume levels of the acoustic signals of the channels, the acoustic effect can be appropriately applied.

[5] In the acoustic processing device according to the fourth aspect, the analysis unit is configured to cause the acoustic effect applying unit to select the first acoustic effect or the second acoustic effect based on the feature amount of the acoustic signal of the rear left channel and the feature amount of the acoustic signal of the rear right channel, and the feature amount of the acoustic signal of the front left channel and the feature amount of the acoustic signal of the front right channel.

According to the fifth aspect, the first acoustic effect can be selected when the feature amounts of the acoustic signals of the front channels is relatively higher than the feature amounts of the acoustic signals of the rear channels. In an opposite case, the second acoustic effect can be selected.

The acoustic processing device of each aspect exemplified above can be realized as an acoustic processing method or as a program that causes a computer to execute a performance analysis method.

What is claimed is:

1. An acoustic processing device comprising:

a memory storing instructions; and a processor that implements the stored instructions to execute a plurality of tasks, including:

an analyzing task that analyzes input acoustic signals of a plurality of channels including a front left channel, a front right channel, a rear left channel, and a rear right channel;

a determining task that determines an acoustic effect to be applied to the input acoustic signals, from among a first acoustic effect of virtual surround and a second acoustic effect of virtual surround different from the first acoustic effect, based on a result of the analyzing task and feature amounts of the acoustic signals of the plurality of channels, including a sum of a feature amount of the acoustic signal of the rear left channel and a feature amount of the acoustic signal of the rear right channel, and a sum of a feature amount of the acoustic signal of the front left channel and a feature amount of the acoustic signal of the front right channel; and an acoustic effect applying task that applies the acoustic effect determined by the determining task to the input signals, wherein the feature amounts of the acoustic signals of the plurality of channels include at least one of volume levels or emission directions of the acoustic signals of the plurality of channels, wherein in a state where a head of a listener is located at a vertical bisector of a virtual line connecting the speakers and a face of the listener faces the speakers in a direction along the vertical bisector;

the first acoustic effect provides a localization region that spreads toward the front of speakers as viewed from the listener; and the second acoustic effect provides a localization region that spreads substantially in 360 degrees surrounding the listener.

2. The acoustic processing device according to claim 1, wherein:

the second acoustic effect provides a greater localization region than the first acoustic effect, and the first acoustic effect provides a smaller sound image range than the second acoustic effect.

3. The acoustic processing device according to claim 1, wherein the feature amounts of the acoustic signals of the plurality of channels are the volume levels of the acoustic signals of the plurality of channels.

4. The acoustic processing device according to claim 1, wherein the feature amounts of the acoustic signals of the plurality of channels are the volume levels and the emission directions of the acoustic signals of the plurality of channels.

5. The acoustic processing device according to claim 1, wherein the determining task further determines the acoustic effect to be applied to the input acoustic signals based on a degree of correlation between the acoustic signal of the front left channel and the acoustic signal of the front right channel, and a degree of correlation between the acoustic signal of the rear left channel and the acoustic signal of the rear right channel.

6. The acoustic processing device according to claim 1, wherein:

the plurality of channels include a front center channel, and the determining task further determines the acoustic effect to be applied to the input signal based on a feature amount of the acoustic signal of the front center channel and the feature amount of the acoustic signal of a channel other than the front center channel among the plurality of channels.

7. The acoustic processing device according to claim 6, wherein the feature amount of the acoustic signal of the front center channel is in a voice brand.

8. The acoustic processing device according to claim 1, wherein the determining task determines the acoustic effect, among the first and second acoustics effects, to be applied to the input acoustic signals based on a result of the analyzing task and the volume levels of the acoustic signals of the plurality of channels, and determines:

the first acoustic effect when a ratio of a sum of a volume level of the acoustic signal of the front left channel and a volume level of the acoustic signal of the front right channel with respect to a sum of a volume level of the acoustic signal of the rear left channel and a volume level of the acoustic signal of the rear right channel is equal to or greater than a predetermined threshold; and the second acoustic effect when the ratio of the sum of the volume level of the acoustic signal of the front left channel and the volume level of the acoustic signal of the front right channel with respect to the sum of the volume level of the acoustic signal of the rear left channel and the volume level of the acoustic signal of the rear right channel is less than the predetermined threshold.

9. The acoustic processing device according to claim 1, wherein the first acoustic effect applies a feedback cross delay.

10. The acoustic processing device according to claim 1, wherein the second acoustic effect applies trans-aural processing.

11. An acoustic processing method comprising:

analyzing input acoustic signals of a plurality of channels including a front left channel, a front right channel, a rear left channel, and a rear right channel;

determining an acoustic effect to be applied to the input acoustic signals, from among a first acoustic effect of virtual surround and a second acoustic effect of virtual surround different from the first acoustic effect, based on a result of the analyzing and feature amounts of the acoustic signals of the plurality of channels, including a sum of a feature amount of the acoustic signal of the rear left channel and a feature amount of the acoustic signal of the rear right channel, and a sum of a feature amount of the acoustic signal of the front left channel and a feature amount of the acoustic signal of the front right channel; and applying the determined acoustic effect to the input signals, wherein the feature amounts of the acoustic signals of the plurality of channels include at least one of volume levels or emission directions of the acoustic signals of the plurality of channels, wherein in a state where a head of a listener is located at a vertical bisector of a virtual line connecting the speakers and a face of the listener faces the speakers in a direction along the vertical bisector:

the first acoustic effect provides a localization region that spreads toward the front of speakers as viewed from the listener; and the second acoustic effect provides a localization region that spreads substantially in 360 degrees surrounding the listener.

12. The acoustic processing method according to claim 11, wherein:

the second acoustic effect provides a greater localization region than the first acoustic effect; and the first acoustic effect provides a smaller sound image range than the second acoustic effect.

13. The acoustic processing method according to claim 11, wherein the feature amounts of the acoustic signals of the plurality of channels are the volume levels of the acoustic signals of the plurality of channels.

14. The acoustic processing method according to claim 11, wherein the feature amounts of the acoustic signals of the channels are the volume levels and the emission directions of the acoustic signals of the plurality of channels.

15. The acoustic processing process according to claim 11, wherein the determining further determines the acoustic effect to be applied to the input signal acoustic signals based on a degree of correlation between the acoustic signal of the front left channel and the acoustic signal of the front right channel, and a degree of correlation between the acoustic signal of the rear left channel and the acoustic signal of the rear right channel.

16. The acoustic processing process according to claim 11, wherein:

the plurality of channels further include a front center channel, and the determining further determines the acoustic effect to be applied to the input signal based on a feature amount of the acoustic signal of the front center channel and the feature amount of the acoustic signal of a channel other than the front center channel among the plurality of channels.

17. The acoustic processing method according to claim 16, wherein the feature amount of the acoustic signal of the front center channel is in a voice band.

18. The acoustic processing method according to claim 11, wherein the determining determines the acoustic effect, among the first and second acoustics effects, to be applied to the input acoustic signals based on a result of the analyzing and the volume levels of the acoustic signals of the plurality of channels, and determines:

the first acoustic effect when a ratio of a sum of a volume level of the acoustic signal of the front left channel and a volume level of the acoustic signal of the front right channel with respect to a sum of a volume level of the acoustic signal of the rear left channel and a volume level of the acoustic signal of the rear right channel is equal to or greater than a predetermined threshold; and the second acoustic effect when the ratio of the sum of the volume level of the acoustic signal of the front left channel and the volume level of the acoustic signal of the front right channel with respect to the sum of the volume level of the acoustic signal of the rear left channel and the volume level of the acoustic signal of the rear right channel is less than the predetermined threshold.

19. The acoustic processing method according to claim 11, wherein the first acoustic effect applies a feedback cross delay.

20. The acoustic processing method according to claim 11, wherein the second acoustic effect applies trans-aural processing.

* * * * *